United States Patent [19]

Kozuka

[11] Patent Number: 4,652,248

[45] Date of Patent: Mar. 24, 1987

[54] TOY VEHICLE AND TRACK

[75] Inventor: Michihiro Kozuka, Tokyo, Japan

[73] Assignee: Tomy Kogyo Co., Inc., Tokyo, Japan

[21] Appl. No.: 745,407

[22] Filed: Jun. 14, 1985

[51] Int. Cl.[4] ..... A63H 18/00

[52] U.S. Cl. ..... 446/444

[58] Field of Search ..... 446/444, 466, 439, 95, 446/93, 107, 90, 445; 104/DIG. 1, 53; 238/10 A, 10 E

[56] References Cited

U.S. PATENT DOCUMENTS 3,337,985 8/1967 Ryan et al. ..... 446/445

3,377,741 4/1968 Ryan ..... 446/444 X 4,579,538 4/1986 Bass et al. ..... 446/107

*Primary Examiner*—Mickey Yu

*Attorney, Agent, or Firm*—Herb Boswell

[57] ABSTRACT

A toy vehicle and track utilizes a track which is formed of a plurality of sections which are connectable together. At least some of the track sections are round tubular elements. The vehicle has only two wheels. When positioned over the track, the vehicle is supported by the two wheels and, at most, a further contact point between the underside of the vehicle and the track.

13 Claims, 4 Drawing Figures

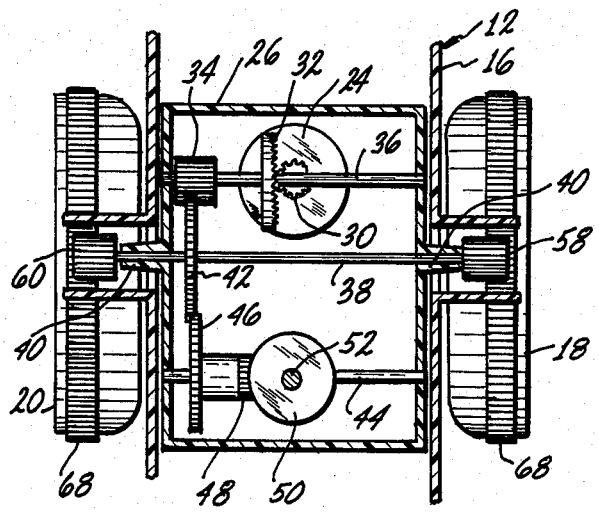
FIG. 3
FIG. 4
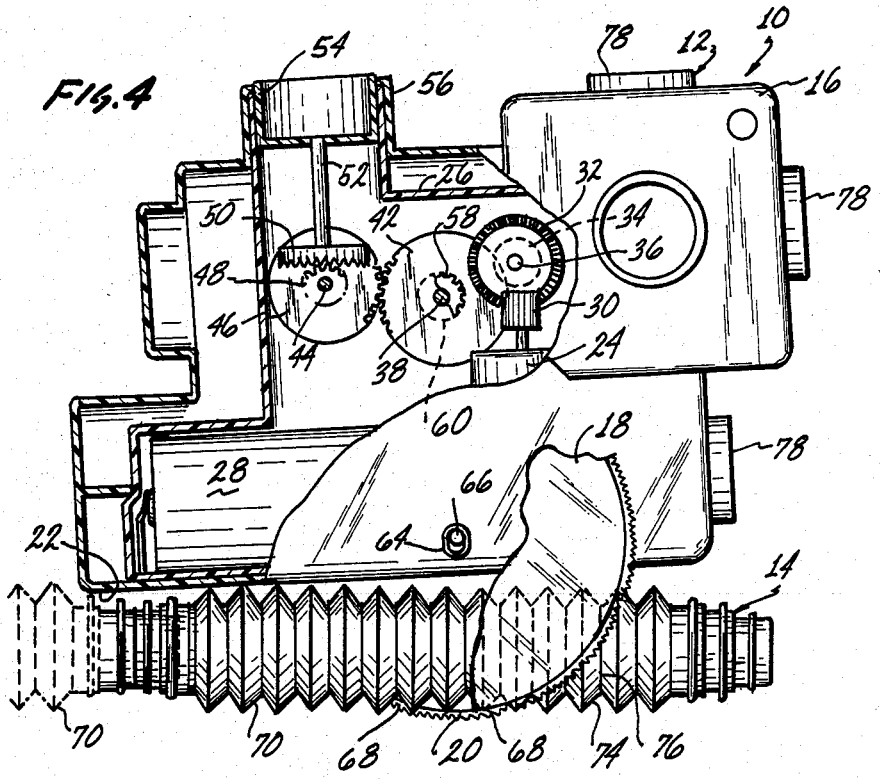

TOY VEHICLE AND TRACK

BACKGROUND OF THE INVENTION

This invention is directed to a two wheeled vehicle and a track for the same wherein the two wheels of the vehicle straddle the track. The vehicle is supported at three points, two of these being the two wheels and the third being a contact point between the bottom of the vehicle and the track.

A variety of vehicles which operate in conjunction with tracks are known. These include the classical electrical train type toys, more modern slot car toys, diecast vehicles which traverse tracks having raised sides, and many others. For the most part, the track configurations are fixed within the limitations imposed by the predetermined shapes of the track as produced by the manufacturer.

Other vehicle and track combinations are also known which utilize a flexible track which can be positioned in a variety of configurations by the user of the toy. At least two of these types of toys are known as are described in U.S. Pat. Nos. 2,821,938 and 3,400,487. In both of these patents, the vehicle utilizes a front wheel which is formed as a sheeve which must be positioned over a flexible track member to guide the vehicle. While these toys are certainly utilitarian, because of the manual dexterity required to position the guide sheeve on the track, the toy is not suitable for preschool age children. The preschool age child does not yet possess the necessary skills for correctly and accurately positioning the controlling sheeve onto the small diameter track.

A variety of toys sold under the tradename of Popoids® utilize flexible connectors which can be expanded and contracted. These connectors have convoluted side walls which can fold into one another. The convoluted side walls of the connector not only allow the connector to be elongated and shortened, but also allow it to be curved. The connector will maintain the curve which is set into the connector when it is released. These tubular elements further include connecting elements on their ends which are easily manipulatable by small children to connect one of the tubular elements to the other.

BRIEF DESCRIPTION OF THE INVENTION

In view of the above, it is a broad object of this invention to provide a toy vehicle and track which is primarily designed for use by a preschool age child. It is a further object of this invention to provide a vehicle which utilizes only two large wheels which are spaced from one another a distance sufficient such that it is very easy for a preschool age child to position the vehicle on the track by simply straddling the wheels of the vehicle over the track. Additionally, it is an object of this invention to provide a track and vehicle which interact in a very simplistic forthright manner allowing for convenient manipulation of the same by a preschool age child without undue frustration or the like being experienced by the child because of undue complexity of operation of the track and vehicle. Further, it is an object of this invention to provide a toy which includes a track and vehicle which because of the engineering and manufacturing principles embodied therein is capable of a long and useful lifetime, yet is economically available to the consuming public.

These and other objects as will become evident from the remainder of this specification are achieved in a toy which comprises: a track; a vehicle; said track including a plurality of track sections, each of said track sections having connectors located thereon, a connector on one of said track sections fitting into a connector on a further of said track sections to join one of said track sections to said further of said track sections; at least a portion of said plurality of track sections formed as tubular elements, said tubular elements being round in cross section; said vehicle including a motor, a left side, a right side, a bottom extending between said left and said right side, and a single wheel located on said right side and a single wheel located on said left side; said vehicle further including means operatively connecting said left side wheel and said right side wheel to said motor such that said wheels are rotated by said motor; each of said left side wheel and said right side wheel extending below said bottom surface a distance slightly greater than the diameter of said tubular elements; said vehicle positionable on said track with said wheels straddling said track and a portion of said bottom surface of said vehicle resting on said track whereby said vehicle is supported on no more than three points, one of said points comprising said left side wheel, one of said points comprising said right side wheel, and the remainder of said points comprising said portion of said bottom surface of said vehicle.

Further, these objects are achieved in providing the wheels of the vehicle with inwardly curving side surfaces such that the sides of the wheels which face each other are arcuate in shape allowing for easy straddling of the wheels over the track. Additionally, in the illustrative embodiment, the motor is connected to the wheels utilizing an auxiliary shaft having drive gears on the end thereof with the drive gears engagable against the top of the wheels. Two wheels are located on an axle which is journalled in vertically orientated slots on the vehicle. When the vehicle rests on its wheels, the axle moves upwardly in the slots to contact the tops of the wheels against the drive gears.

BRIEF DESCRIPTION OF THE DRAWINGS

This invention will be better understood when taken in conjunction with the drawings wherein:

FIG. 3 is a top plan view about the line 3—3 of FIG. 1; and

FIG. 4 is a side elevational view in partial section of the vehicle and track of FIG. 1.

This invention utilizes certain principles and/or concepts as are set forth in the claims appended hereto. Those skilled in the toy arts will realize that these principles and concepts are capable of being utilized in a variety of embodiments which may differ from the exact embodiment utilized for illustrative purposes. For this reason this invention is not to be construed as being limited solely to the illustrative embodiment but should only be construed as being limited in view of the claims.

DETAILED DESCRIPTION OF THE INVENTION

Figure 1:
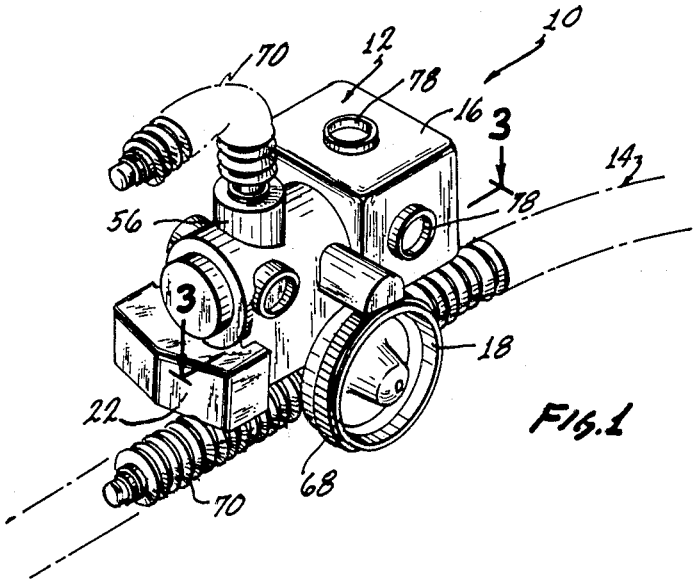
FIG. 1 is an isometric view of a toy vehicle and track of the invention.
Figure 2:
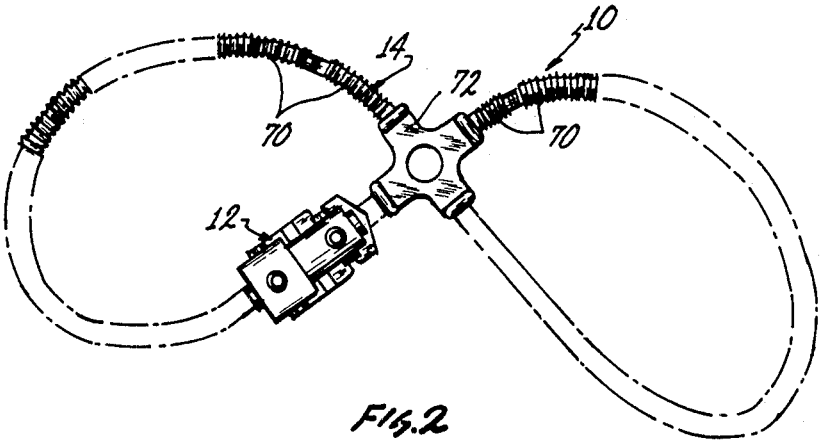
FIG. 2 is a plan view of a typical track layout.

The toy 10 of the invention shown in FIG. 1 has two main component parts. These are the vehicle 12 and track 14. A portion of the track is seen in FIG. 1 with a more complete track layout shown in FIG. 2. The vehicle 12 has an outside housing 16 formed as a characterized steam engine. The vehicle 12 includes only two wheels, left wheel 18 and right wheel 20. It is supported on the track 14 by the two wheels 18 and 20 in conjunction with the bottom surface 22 of the vehicle 12.

The small battery powered motor 24 is located within an internal housing structure 26. Also located within the internal housing structure 26 is a battery 28. The battery 28 is appropriately electrically connected to the motor 24 to supply power to the motor 24. The motor 24 includes an output pinion 30 which meshes with a crown gear 32. The crown gear is integrally formed with a pinion 34, and both are carried on a shaft 36 which is journalled within the internal housing 26.

A further shaft 38 is journalled in left and right side bosses, collectively identified by the numeral 40, which are integrally formed as a portion of the internal housing 26. The shaft 38 has a large spur gear 42 fixed to it. The spur gear 42 meshes with the pinion 34 and, therefore, is ultimately rotated in response to rotation of the motor 24. A further shaft 44 is positioned forward of the shaft 38 and is also journalled within the internal housing 26. The shaft 44 carries a spur gear 46 thereon which meshes with and is rotated by the spur gear 42.

The shaft 44 also has a pinion 48 fixed to it such that it rotates in response to rotation of the spur gear 46. The pinion 48 meshes with a crown gear 50 which is attached to a shaft 52 which is journalled in the top of the internal housing 26. The shaft 52 has a hollow boss 54 attached to its upper surface. In response to rotation of the spur gear 46, the motion is transferred to the crown gear 50 by the pinion 48 which, in turn, rotates the boss 54.

The boss 54 is positioned within the inside of a smoke stack 56 on the upper part of the housing 16. The size and shape of the boss 54 is such that one of the individual track sections, as hereinafter explained, can be inserted into the boss 54 and rotated in response to output of the motor 24.

The shaft 38 includes a drive gear 58 on its left side, and a similar drive gear 60 on its right side. The drive gears 58 and 60 are exposed out of the left and right sides respectively of the housing 16. A small hemi-cylindrical cover 62 integrally formed as a portion of the housing 16 covers the upper portion of the drive gear 58 such that only the lower portion is exposed. A similar cover, not separately numbered or shown, covers the upper portion of the drive gear 60.

The left and right sides of the housing 16 each include a slot, as per slot 64 shown for the left side. The slot 64 is vertically oriented. An axle 66 passes through the slots 64 and projects outwardly on both the left and right sides of the housing 16. The wheels 18 and 20 are fixed to the axle 66 and are supported by the axle 66. If the vehicle 12 is lifted upwardly from the surface of the track 14, the axle 66 under the weight of the wheels 18 and 20, descends downwardly into the bottom of the slot. When the vehicle 12 is set down onto a support surface and the wheels 18 and 20 contact the support surface, the axle 66 is pushed upward within the slots 64 until the top of the wheels 18 and 20 contact the respective drive gears 58 and 60.

Each of the wheels 18 and 20 has a circular rubber grip 68 formed on their outer periphery with which the drive gears 58 and 60 engage against so as to rotate the wheels 18 and 20 when the wheels 18 and 20 are pressed upwardly against the drive gears 58 and 60 by movement of the axle 66 upwardly in the slots 64. If the housing 16 of the vehicle 12 is elevated, allowing the wheels 18 and 20 to descend downwardly, this breaks the connection between the drive gears 58 and 60 and the rubber grips 68, and the drive gears 58 and 60 no longer rotate the wheels 18 and 20. This serves as a clutch mechanism.

The battery 28 is placed forward of the axle 66. Insofar as the battery 28 is massive with respect to the remainder of the components of the vehicle 12, this locates the center of gravity of the vehicle 12 forward of the axle 66. As viewed in FIG. 4, to move the vehicle 12 forward, that is to the left, the wheels 18 and 20 must rotate counterclockwise and the drive gears 58 and 60 clockwise. The rotation of the drive gears clockwise on the wheels 18 and 20 tends to rotate the totality of the housing 16 clockwise about the axle 66. This counteracts the forward center of gravity and tends to balance the vehicle 12 on only the two wheels 18 and 20. Thus, most of the time the vehicle 12 tends to move along the track 14 on only two points of contact, i.e., the wheels 18 and 20, and never is it supported on more than three points of contact, i.e., the two wheels 18 and 20 and a portion of the bottom surface 22.

Access to the battery 28 within the internal housing 26 is through a hinge portion, not separately numbered or shown, formed in the bottom surface 22. When closed, the hinge portion fits smoothly with respect to the remainder of the bottom surface 22 such that the totality of the bottom surface 22 is essentially smooth and flat.

The track 14 is made of a plurality of individual sections. These include a plurality of identical tubular elements 70 and one or more other connectors such as crossing connector 72. The tubular elements 70 are formed of a plastic material having a male connector on one end and a combination male/female connector on the other end as is described in application Ser. No. 562,721, filed Jan. 16, 1984, entitled Construction Toy and assigned to the same assignee as this application, the entire contents of which are herein incorporated by reference. Each of the bodies of the elements are formed of a plurality or connected corrugations, with each corrugation alternately formed of first and second truncated conical walls 74 and 76 respectively. The first conical wall 74 is larger than the second conical wall 76 with the alternating conical walls hinged together base to base about a circumferentially extending convex hinge and apex about a circumferentially extending concave hinge. The short wall 76 is nestable within the larger wall 74 when the tubular elements 70 are shortened and is extendable away from the wall 74 when the tubular elements 70 is elonated.

In expanding or contracting the tubular elements 70, it is not necessary to extend the short wall 76 around its total circumferential surface from within the interior of the larger wall 74. A portion of it can be extended, with the remainder portion being nestable. This allows the tubular elements 70 to curve. In fact, it is possible to produce compound curves within a single tubular element 70 by curving one portion in one direction and a further portion in another direction.

Because of the possibility of shortening and elongating the tubular elements, and bending them in compound curves, the track 14 can be shaped to assume a variety of configurations by just bending the tubular elements 70 on themselves.

The crossing connector 72 includes four female openings, none of which is separately numbered or shown, which accept the male or the combination male/female connectors respectively of the tubular elements 70 so as to join the tubular elements 70 to the crossing connector 72.

Once a track 14 is constructed by connecting the individual tubular elements 70 and the crossing connector 72, or other similar track components, the vehicle 12 is then placed over the track 14 by simply straddling the left and right wheels 18 and 20 over the track 14. Since the spacing between the wheels 18 and 20 is quite large, it is very easy for a preschool age child to place the vehicle 12 onto the track 14. Once placed on the track 14, the vehicle 12 at rest, under the bias of the batteries 28, tilts slightly forward such that the forward end of the bottom surface 22, below the batteries 28, rests on top of the track 14.

The inside surfaces of the wheels 18 and 20 are gently curved in large arcs. This assists in both placing of the vehicle 12 on the track 14, and assists in the vehicle 12 negotiating turns on the track 14. As the inside arcuate shaped surface of a wheel 18 or 20 engages the inside of a curve on the track 14, the arcuate shape of the inside of the wheel 18 or 20 allows the vehicle 12 to slide around the curve without the inside of the wheel 18 or 20 locking up against the convolutions of the tubular elements 70.

The distance the left and right wheels 18 and 20 descend downwardly below the bottom surface 22 is just slightly greater than the largest diameter of the tubular elements 70. This allows the vehicle 12 to straddle the track 14 and when tilted either forward or backward having a portion of its bottom surface 22 resting on the track of the tubular elements 70. Since the tubular elements 70 are round in cross section irrespective of where the cross section is taken, any portion of the bottom surface 22 which rests on the track 14 will always rest on the highest portion of the track 14. This allows the bottom surface 22 to easily slide over the track 14 to maintain either a two point or three point connection of the vehicle 12 with the track 14 and the support surface, on which both the track 14 and the wheels 18 and 20 of the vehicle 12 rest on.

The housing 16 of the vehicle 12 includes a plurality of bosses, collectively identified by the numeral 78, which are sized and shaped so as to receive the ends of the tubular elements 70 therein. This allows the child utilizing the toy 10 to change the appearance of the vehicle 12 by attaching the individual tubular elements 70 to the respective bosses 78. Also, as noted above, the smoke stack 56 is also formed as a hollow tubular element and includes the boss 54 located therein. The boss 54 is also sized and shaped to receive the ends of the tubular elements 70 such that one of the tubular elements 70 can project out of the smoke stack 56 as is seen in FIG. 1. By putting a bend in the tubular elements 70, located therein, the tubular element swings in a conical manner as it rotates within the smoke stack 56.

I claim:

1. A toy which comprises:

a track;

a vehicle;

said track including a plurality of track sections, each of said track sections having two connectors located thereon, a connector on one of said track sections fitting into a connector on a further of said track sections to join one of said track sections to said further of said track sections;

at least a portion of said plurality of track sections formed as tubular elements, said tubular elements being round in cross section;

said vehicle including a motor, a left side, a right side, a flat/smooth bottom extending between said left and said right side, and no more than a single wheel located on said right side and no more than a single wheel located on said left side;

said vehicle further including means operatively connecting said left side wheel and said right side wheel to said motor such that said wheels are rotated by said motor;

each of said left side wheel and said right side wheel extending below said bottom surface a distance slightly greater than the diameter of said tubular elements;

said vehicle positionable on said track with said wheels straddling said track and a portion of said bottom surface of said vehicle positioned over said track whereby said vehicle is supported on no more than three points, one of said points comprising said left side wheel, one of said points comprising said right side wheel, and the remainder of said points comprising a portion of said flat/smooth bottom surface of said vehicle.

2. The toy of claim 1 wherein:

said tubular elements comprise elongated tubular elements having expansion and contraction means located thereon, said tubular elements independently expandable and contractable between elongated positions and shortened positions.

3. The toy of claim 2 wherein:

each of said tubular elements is formed of a plastic material having first and second ends connected by an element body;

said element body including a plurality of connected corrugations, said corrugations formed by alternating first and second truncated conical walls joined together base to base about circumferentially extending convex hinges and apex to apex about circumferentially extending concave hinges, said first conical walls shorter than said second conical walls such that they are nestable within said second conical walls.

4. A toy of claim 1 wherein:

said vehicle further includes each of said left and said right wheels mounted on an axle;

each of said left and said right sides of said vehicle including a vertically oriented elongated slot, said axle passing through said slot, said left and said right wheels moveable vertically along said left and said right sides respectively of said vehicle in conjunction with movement of said axle vertically within said slot.

5. The toy of claim 4 further including:

a shaft passing through said vehicle and projecting beyond both said left and said right sides of said vehicle, a drive gear located on each of the ends of said shaft external said left and said right sides of said vehicle;

gear train means operatively associated with both said motor and said shaft, said motor rotating said gear train means and, in turn, said gear train means rotating said shaft and said drive gears located thereon;

said left and said right side wheels engaging said drive gears on the ends of said shaft in response to upward movement of said axle within said slots, said drive gears rotating said left and said right side wheels in response to contact of said drive gears by said wheels.

6. The toy of claim 1 wherein:

each of said left and said right side wheels extend arcuately inwardly from the periphery of said wheels toward the center of said wheels on the side of each of said wheels which face the other said wheels.

7. The toy of claim 1 wherein:

said motor is a battery powered motor;

said vehicle further including batteries electrically connected to said motor so as to power said motor, said batteries positioned in said vehicle in front of the center of rotation of said wheels such that the mass of said batteries downwardly biases said portion of said vehicle located in front of the center of rotation of said wheels biasing said flat/smooth bottom surface against said track.

8. The toy of claim 7 including:

a shaft passing through said vehicle and projecting beyond both said left and said right sides of said vehicle, a drive gear located on each of the ends of said shaft external said left and said right sides of said vehicle;

gear train means operatively associated with both said motor and said shaft, said motor rotating said gear train means and, in turn, said gear train means rotating said shaft and said drive gears located thereon;

said left and said right side wheels engaging said drive gears on the ends of said shaft, said drive gears rotating said left and said right side wheels in response to contact of said drive gears by said wheels.

9. The toy of claim 8 wherein:

said drive gears engage the tops of said left and said right side wheels and as said drive gears rotate said wheels, said vehicle biased so as to rotate about said axle in a direction opposite said bias imparted to said vehicle by said battery to balance said vehicle on said two wheels.

10. The toy of claim 5 wherein:

each of said left and said right side wheels extend arcuately inwardly from the periphery of said wheels toward the center of said wheels on the side of each of said wheels which face the other said wheels.

11. The toy of claim 10 wherein:

said motor is a battery powered motor;

said vehicle further including batteries electrically connected to said motor so as to power said motor, said batteries positioned in said vehicle in front of the center of rotation of said wheels such that the mass of said batteries downwardly biases said portion of said vehicle located in front of the center of rotation of said wheels.

12. The toy of claim 1 including:

a shaft passing through said vehicle and projecting beyond both said left and said right sides of said vehicle, a drive gear located on each of the ends of said shaft external said left and said right sides of said vehicle;

gear train means operatively associated with both said motor and said shaft, said motor rotating said gear train means and, in turn, said gear train means rotating said shaft and said drive gears located thereon;

said left and said right side wheels engaging said drive gears on the ends of said shaft, said drive gears rotating said left and said right side wheels in response to contact of said drive gears by said wheels.

13. The toy of claim 12 wherein:

said drive gears engage to tops of said wheels.

* * * * *